US006570334B2

(12) United States Patent
Kastner

(10) Patent No.: US 6,570,334 B2
(45) Date of Patent: May 27, 2003

(54) GAS-DISCHARGE LAMP INCLUDING A FAULT PROTECTION CIRCUIT

(75) Inventor: Mark Kastner, New Berlin, WI (US)

(73) Assignee: Everbrite, Inc., Greenfield, WI (US)

( * ) Notice: Subject to any disclaimer, the term of this patent is extended or adjusted under 35 U.S.C. 154(b) by 20 days.

(21) Appl. No.: 09/870,303

(22) Filed: May 30, 2001

(65) Prior Publication Data

US 2002/0047629 A1 Apr. 25, 2002

Related U.S. Application Data

(60) Provisional application No. 60/208,693, filed on Jun. 1, 2000.

(51) Int. Cl.[7] ..... H05B 37/00

(52) U.S. Cl. ..... 315/119; 315/224; 315/291; 315/307

(58) Field of Search ..... 315/209 R, 219, 315/224, 291, 307, 362, DIG. 4, 119, 246; 361/38, 42

(56) References Cited

U.S. PATENT DOCUMENTS

| | | | | |
|---|---|---|---|---|
| 3,611,038 | A | 10/1971 | Benham | 317/18 D |
| 4,344,100 | A | 8/1982 | Davidson et al. | 361/45 |
| 4,367,224 | A | 1/1983 | Van Scott et al. | 424/175 |
| 4,461,980 | A | 7/1984 | Nilssen | 315/225 |
| 4,507,698 | A | 3/1985 | Nilssen | 361/42 |
| 4,538,095 | A | 8/1985 | Nilssen | 315/244 |
| 4,663,571 | A | 5/1987 | Nilssen | 315/244 |
| 4,745,342 | A | 5/1988 | Andresen et al. | 315/200 R |
| RE32,901 | E | 4/1989 | Nilssen | 315/244 |
| RE32,953 | E | 6/1989 | Nilssen | 315/224 |
| 4,855,860 | A | 8/1989 | Nilssen | 361/45 |
| 4,970,438 | A | 11/1990 | Nilssen | 315/225 |
| 4,980,611 | A | 12/1990 | Orenstein | 315/225 |
| 5,039,919 | A | 8/1991 | Nilssen | 315/209 R |
| 5,049,787 | A | 9/1991 | Nilssen | 315/209 R |
| 5,055,747 | A | 10/1991 | Johns | 315/307 |
| 5,081,399 | A | 1/1992 | Jy | 315/121 |
| 5,103,139 | A | 4/1992 | Nilssen | 315/219 |
| 5,249,273 | A | 9/1993 | Yoshitake et al. | 395/375 |
| 5,291,099 | A | 3/1994 | Gill et al. | 315/119 |
| 5,355,055 | A * | 10/1994 | Tary | 315/209 R |
| 5,363,018 | A | 11/1994 | Shackle | 315/127 |
| 5,424,893 | A | 6/1995 | Francis, Jr. et al. | 361/45 |
| 5,550,437 | A * | 8/1996 | Hopkins et al. | 315/209 R |
| 5,668,444 | A * | 9/1997 | Pacholok | 315/224 |
| 5,680,286 | A | 10/1997 | Pacholok | 361/42 |
| 5,751,523 | A * | 5/1998 | Ballard et al. | 361/142 |
| 5,805,399 | A | 9/1998 | Pacholok | 361/57 |
| 5,914,843 | A | 6/1999 | Hopkins et al. | 361/42 |
| 5,949,197 | A * | 9/1999 | Kastner | 315/291 |
| 5,978,190 | A | 11/1999 | Mignault | 361/42 |
| 6,104,585 | A | 8/2000 | Matsui et al. | 361/38 |
| 6,175,189 | B1 * | 1/2001 | Brooks | 315/119 |

* cited by examiner

*Primary Examiner*—Don Wong
*Assistant Examiner*—Jimmy T. Vu
(74) *Attorney, Agent, or Firm*—Michael Best & Friedrich LLP

(57) ABSTRACT

A gas discharge lamp including a power supply connectable to a load, and an overvoltage-protection-and-ground-fault-interrupt (OVP/GFI) circuit interconnected with the power supply. The OVP/GFI circuit includes an overvoltage-protection (OVP) sub-circuit that deactivates the power supply when an overvoltage condition is detected, and a ground-fault-interrupt (GFI) sub-circuit that deactivates the power supply when a ground-fault condition is detected.

36 Claims, 5 Drawing Sheets

GAS-DISCHARGE LAMP INCLUDING A FAULT PROTECTION CIRCUIT

RELATED APPLICATION

This application claims priority to U.S. Provisional Patent Application No. 60/208,693, entitled GROUND FAULT AND OVER VOLTAGE FAULT SHUTDOWN CIRCUIT FOR NEON POWER SUPPLIES, filed Jun. 1, 2000.

BACKGROUND OF THE INVENTION

The invention relates to a gas-discharge lamp including a fault protection circuit, and particularly to a gas-discharge lamp including a combination overvoltage-protection-and-ground-fault-interrupt circuit.

Safety agencies such as UL, CSA, and CE require output ground fault protection on electronic power supplies for neon signs and other gas discharge lamp applications. A ground-fault-interrupt circuit interrupts or deactivates the power supply in the event of a ground fault occurrence. In addition, these agencies set limits on the maximum output voltage that may be produced by the power supply. An overvoltage-protection circuit interrupts or deactivates the power supply in the event of an overvoltage condition. In order to prevent nuisance tripping and to ensure the fault trip occurs when the limiting value of ground fault current or output voltage is reached, it is desirable to make these circuits as accurate as possible. However, due to the competitive nature of the gas-discharge lamp market, these circuits should be as inexpensive as possible. Thus, it would be beneficial to have a sensitive and inexpensive circuit for detecting both a ground-fault condition and an overvoltage condition.

SUMMARY OF THE INVENTION

Accordingly, in one embodiment, the invention provides a gas discharge lamp including a power supply connectable to a load (e.g., one or more gas-discharge tubes), and an overvoltage-protection-and-ground-fault-interrupt (OVP/GFI) circuit interconnected with the power supply. The OVP/GFI circuit includes an overvoltage-protection (OVP) sub-circuit that deactivates the power supply when an overvoltage condition is detected, and a ground-fault-interrupt (GFI) sub-circuit that deactivates the power supply when a ground-fault condition is detected.

In a second embodiment, the invention provides a gas-discharge lamp including a power supply having a secondary winding connectable to a load, and an overvoltage-protection-and-ground-fault-interrupt (OVP/GFI) circuit interconnected with the power supply. The OVP/GFI circuit includes an overvoltage-condition-and-ground-fault-condition (OC/GFC) sensor that is operable to sense both an overvoltage condition being created by the power supply and a ground-fault condition being created in the secondary winding. The OC/GFC sensor is further operable to generate a fault signal when either condition occurs. The OVP/GFI circuit further includes a shut-down device interconnected with the OC/GFC sensor. The shut-down device deactivates the power supply from supplying power to the load upon receiving the fault signal.

Using one sensor or one circuit to sense a ground-fault condition or an overvoltage condition in a gas-discharge power supply helps to eliminate redundant components of separate ground-fault-interrupt and overvoltage protection sensors or circuits. This results in a reduction of overall cost in the sensor or circuit. Other features and advantages of the invention will become apparent to those skilled in the art upon review of the following detailed description, claims, and drawings.

Before any embodiments of the invention are explained in full detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

DETAILED DESCRIPTION

Figure 1:
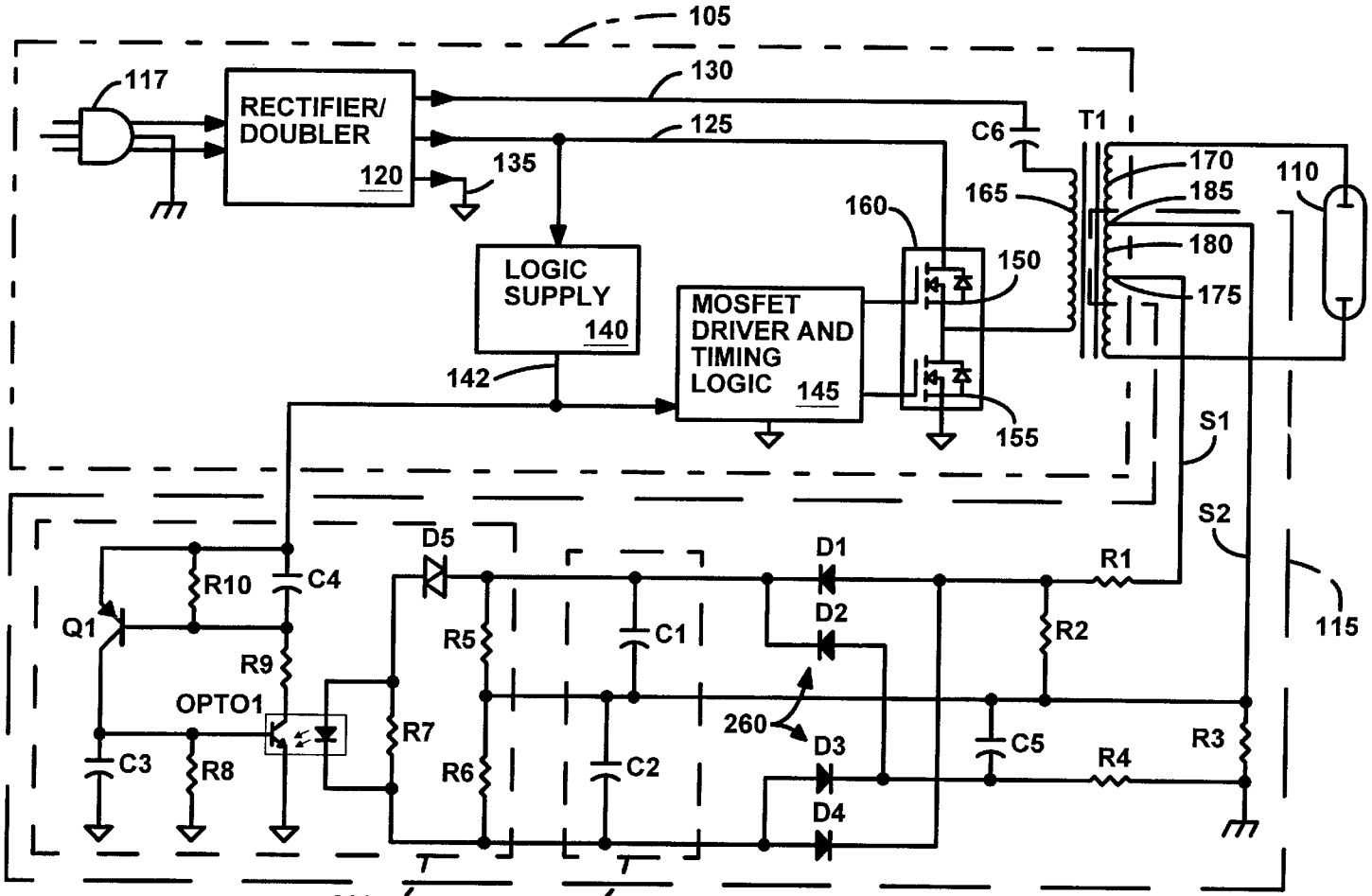
FIG. 1 is a combination block and electrical schematic of a gas-discharge lamp of the invention including an OVP/GFI circuit.

A gas discharge lamp 100 of the invention is schematically shown in FIG. 1. Although the description herein is for a neon gas discharge lamp, other gas-discharge lamps or gas-discharge signs may be used with the invention. The gas discharge lamp 100 of the invention generally includes a power supply 105, a load 110, and a combination overvoltage-protection-and-ground-fault-interrupt (GFI/OVP) circuit 115.

As shown in FIG. 1, the power supply 105 includes a terminal 117 that connects to a power source. The power source may be a 120 volt, alternating current (VAC) power source or a 240 VAC power source. The AC voltage from the power source is provided to a rectifier/doubler circuit 120, which is well known in the art. The AC voltage from the power source is rectified and doubled (if a 120 VAC source) to form a high-voltage rail 125 (e.g., 340 VDC), an intermediate-voltage rail 130 (e.g., 170 VDC), and a low-voltage rail 135 (e.g., 0 VDC). Although a rectifier/doubler circuit 120 is shown, for 240 VAC applications, only a bridge rectifier is required. Further, the voltages of the high-voltage, intermediate-voltage, and low-voltage rails 125, 130 and 135 may vary.

A logic power supply 140 is electrically interconnected to the high-voltage rail 125 and creates a bias voltage 142 (e.g., 15 VDC) for powering logic components. The logic components include a MOSFET driver and timing logic circuit 145 for driving first and second MOSFETs 150 and 155. The logic supply 140 is a high impedance bias supply, may be a charge pump, and may contain large dropping resistors. The first and second MOSFETs 150 and 155 are connected in a half H-bridge configuration (also referred to as a power MOSFET half-bridge circuit 160). The first MOSFET 150 is connected to the high-voltage rail 125, the bridge center is connected to a primary side 165 of a transformer T1, and the second MOSFET 155 is connected to the low-voltage rail 135 (also referred to as circuit common). The other end of the primary winding 165 is connected to a capacitor C6, which is connected to the intermediate-voltage rail 130. The capacitor C6 and the primary winding 165 create an LC resonant circuit. The power MOSFET half-bridge circuit 160 drives the transformer T1 with a varying drive signal having a desired output frequency. The varying drive signal may be an AC signal or an AC signal with a DC offset. Further, the AC signal may be symmetric or asymmetric. All of these signals will be collectively referred to herein as an AC signal. The AC drive signal is reflected at a secondary winding 170, which produces an output AC signal having a desired output voltage and frequency. The power supply 105 and its operation are well known to one of ordinary skill in the art and may be implemented using discrete circuitry, integrated circuitry, and/or a microprocessor and memory.

The load 110 includes at least one gas-discharge tube interconnected with the secondary side of the transformer T1. For the embodiment shown, the load 110 is a single neon tube driven by the power supply 105 at a desired voltage and a desired frequency. The voltage and frequency applied to the load 110 may vary depending on the application.

The OVP/GFI circuit 115 is electrically interconnected with the power supply 105 by tapping a winding tap 175 on the secondary winding 170 of transformer T1, and having the OVP/GFI circuit 115 include a sense winding 180 mounted on the core of the transformer T1. In one embodiment, the sense winding 180 is interconnected with the secondary winding 170 at the winding tap 175. In the embodiment shown in FIG. 1, the OVP/GFI circuit 115 includes a pair of winding taps 175 and 182 on the secondary winding 170, where the sense winding 180 creates a sub-winding. The sub-winding is located at the center of the secondary, and is composed of fewer turns than the entire secondary winding. For example, the secondary winding may be 4000 turns, and the sense winding may be 20 turns. The winding tap 175 and the sense winding 180 allow the OVP/GFI circuit 115 to sense either an overvoltage fault condition, or a ground-fault condition. As used herein, an overvoltage condition occurs when an abnormal voltage higher than the normal service voltage is supplied to the load 110, and a ground-fault condition occurs when a potentially dangerous current path unexpectedly exists from the secondary winding to earth ground.

Figure 2:
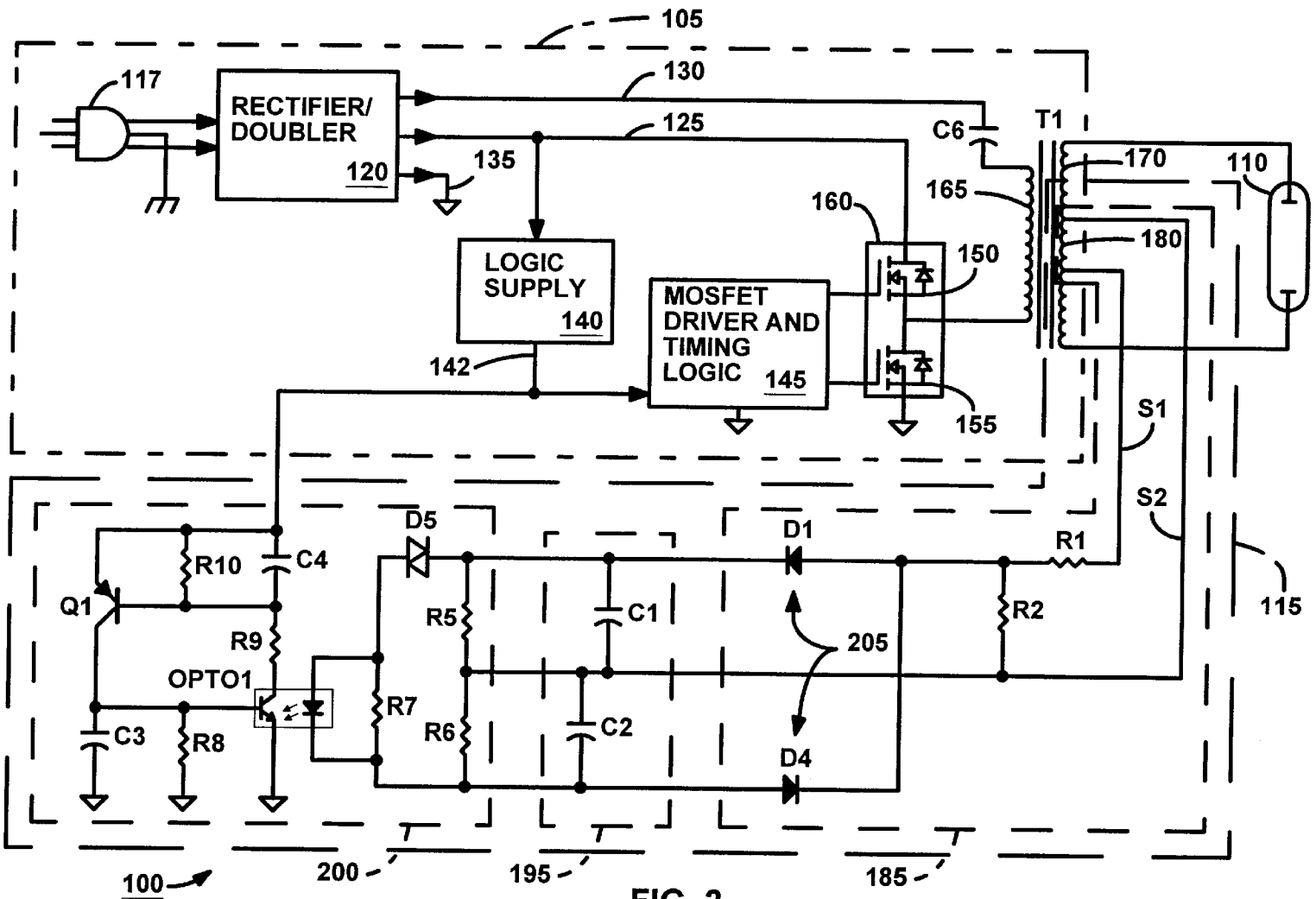
FIG. 2 is a combination block and electrical schematic of the gas-discharge lamp of FIG. 1 with the current sensor of the OVP/GFI circuit removed.
Figure 3:
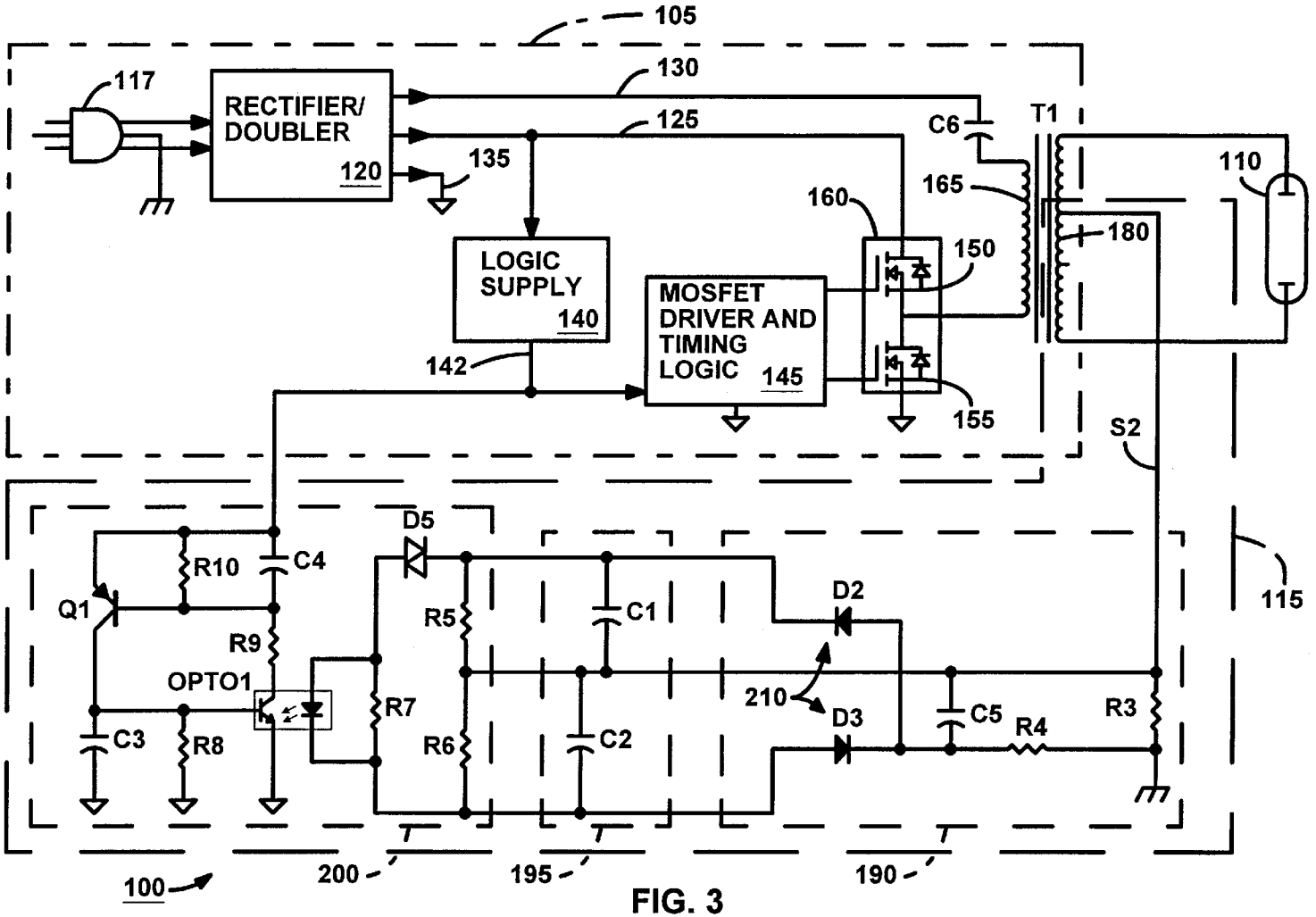
FIG. 3 is a combination block and electrical schematic of the gas-discharge lamp of FIG. 1 with the voltage sensor of the OVP/GFI circuit removed.

The OVP/GFI circuit 115 includes a voltage sensor 185 (best shown in FIG. 2), a current sensor 190 (best shown in FIG. 3), a storage device 195 (e.g., capacitors C1 and C2, FIG. 1) and a shut-down device 200 (FIG. 1). FIG. 1 shows one embodiment of the OVP/GFI circuit 115, FIG. 2 shows the OVP/GFI circuit with the current sensor 190 removed, and FIG. 3 shows the OVP/GFI circuit with the voltage sensor 185 removed. The voltage sensor 185, the storage device 195 and the shut-down device 200 form an overvoltage-protection sub-circuit, and the current sensor 190, the storage device 195 and the shut-down device 200 form a ground-fault interrupt sub-circuit.

In general, the voltage sensor 185 generates a second voltage or signal having a relationship to a first voltage or signal supplied to the load 110 by the power supply 105. The second voltage includes a first positive peak voltage and a first negative peak voltage. The current sensor 190 generates a third voltage or signal having a relationship to the current being produced during a ground-fault condition. The third voltage includes a second positive peak voltage and a second negative peak voltage. The storage device 195 stores a fourth voltage, which is the combination of the larger of the first and second positive peak voltages and the first and second negative peak voltages. The storing of the voltages is discussed in more detail below with respect to FIGS. 4-6. The shut-down device 200 deactivates the power supply when the fourth voltage is larger than a predetermined voltage signifying a fault condition (e.g., an overvoltage condition or a ground-fault condition).

As shown in FIGS. 1 and 2, the voltage sensor includes sense winding 180, resistors R1 and R2, and diodes D1 and D4. The voltage developed across the sense winding 180 is proportional to the voltage on the entire secondary winding 170. Resistors R1 and R2 form a voltage divider to attenuate the voltage signal from the sense winding 180 to a point where the desired voltage is developed at the fault trip point. Positive voltage signals on line S1 (with respect to line S2) flow through diode D1 to charge capacitor C1. Negative voltage signals on S1 (with respect to S2) flow through diode D4 to charge capacitor C2.

As shown in FIGS. 1 and 3, the current sensor 190 includes resistors R3 and R4, capacitor C5 and diodes D2 and D3. If a secondary ground fault current occurs, it flows out of the secondary winding at sense line S2, through resistor R3, and to earth ground. The passing current through R3 develops a voltage proportional to the ground fault current level. The positive voltage (at the bottom of R3 with respect to the top of R3) passes through resistor R4, through diode D2, and is used to charge C1. The negative voltage passes through R4 and diode D3, and is used to charge C2.

As shown in FIGS. 1–3, the storage device 195 includes capacitors C1 and C2. Other storage devices are possible including using a capacitor bank in replace of capacitors C1 or C2. Capacitors C1 and C2, along with resistors R1 and R2 (for OVP) and resistors R3 and R4 (for GFI) also filter the incoming fault signals to help prevent nuisance fault tripping due to noise.

The shut-down device (FIGS. 1–3) 200 includes resistors R5, R6, R7, R8, R9 and R10, capacitors C3 and C4, diac D5, opto-transistor OPTO1, and transistor Q1. The shut-down device is electrically interconnected with the storage device 195 and deactivates or interrupts the power supply 105 when either an overvoltage condition or ground-fault condition occurs. Resistors R5 and R6 provide a slow discharge path for capacitors C1 and C2 of the storage device 190. When the sum of the voltages across capacitors C1 and C2 exceeds the breakdown voltage of diac D5 and the forward drop of the LED in opto-transistor OPTO1, the diac suddenly snaps from a normally non-conduction state to a conduction state. The current surge through the LED triggers the transistor within the optotransistor OPTO1. Resistor R7 provides a high impedance leakage path around the opto-transistor's LED, to help prevent false fault triggering of optotransistor OPTO1.

Triggering the transistor of the opto-transistor OPTO1 allows current flow through the transistor, causing the opto-transistor OPTO1 to sink current from the base of transistor Q1. Sinking current at the base of transistor Q1 allows current flow through transistor Q1. Transistor Q1 then adds current to the base of the opto-transistor OPTO1, and latches the shut-down device 200. The opto-transistor OPTO1 and transistor Q1 enables the fine-tuning of the sensitivity of the shut-down device 200. Resistor R8 and capacitor C3 provide noise immunity for the opto-transistor OPTO1, and resistor R10 and capacitor C4 do the same for Q1. Providing noise immunity prevents transients occurring during power up from deactivating the power supply. Although the shut-down device 200 shown includes the opto-transistor OPTO1 and transistor Q1, other circuitry may be used, including an opto-silicon-controlled rectifier.

When the shut-down device 200 latches, it pulls down hard on the bias voltage 142 to the MOSFET driver and timing logic circuit 140. This effectively shuts down or deactivates the power supply 105. Because of the high input impedance of the logic power supply 140, the shut-down device 200 is able to clamp the logic power supply 140 to ground without causing any component to overheat. In order to re-start the power supply 105, the holding current must be removed from the shut-down device 200. For example, an operator may cycle a master power switch, or may unplug and then re-power the lamp 100.

Assuming both peaks of either the second or third voltage (discussed above and with reference to FIGS. 4–6) are greater than the other voltage, then the larger peak-to-peak voltage charges the storage device 200. Only one set of components is required to sense both excessive ground-fault current and overvoltage. The storage device 190 stores or "records" the greater of the fault signals, and responds to the signal that exceeds a predetermined threshold. The elimination of components reduces circuit component cost, as well as the circuit board area. The latter of these advantages is especially significant for the single-sided trace-circuit boards typically used in gas-discharge lamps.

For the embodiment shown, the sense winding 180 of the voltage sensor 185 includes a common tap 175 with the current line of the current sensor 190. It is desirable to have the ground fault circuit cause a fault trip at the same RMS value of ground fault current regardless of whether the current is resistive or capacitive (whether the ground fault "load" looks like a capacitor or a resistor). However, these two GFI load type extremes create ground fault currents with very different waveshapes. Specifically, while the resistive case causes a ground fault current that is roughly sinusoidal, the capacitive case causes a current that is much more peaky and noisy. Capacitor C5, when installed, forms a low pass filter in conjunction with resistor R4. This filter is tuned to have a cut off frequency of roughly the output frequency of the power supply 105. This eliminates most of the harmonic content in the sensed current waveform, and allows the ground-fault-current sub-circuit to trip at roughly the same threshold for resistive and capacitive currents.

The OVP/GFI circuit 115 is accurate because it uses a voltage proportional to the voltage driving the load 110 and uses the actual ground-fault current. It is inexpensive since it combines the two circuits, resulting in the removal of redundant components. Additionally, the components used are all inexpensive, generic components.

Figure 4:
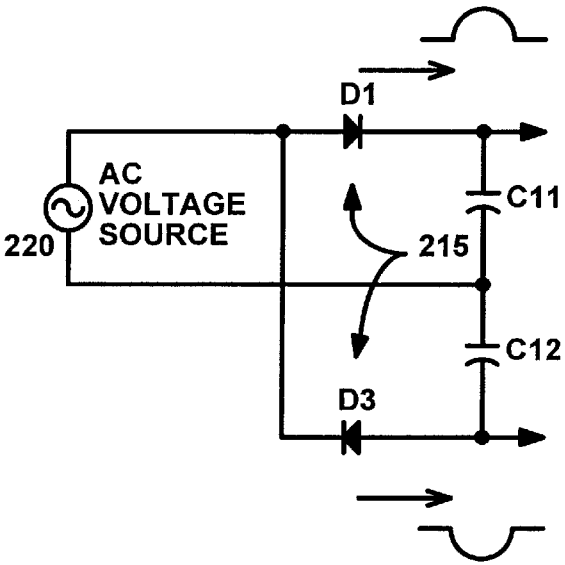
FIG. 4 is an electrical schematic of a circuit including a voltage-doubler rectifier.

The OVP/GFI circuit shown includes a first voltage-doubler rectifier 205 (best shown in FIG. 2) including diodes D1 and D4, and a second voltage-doubler rectifier 210 (best shown in FIG. 3) including diodes D2 and D3. As was explained above, the first and second voltage-doubler rectifiers 205 and 210 charge the same pair of capacitors C1 and C2 of the storage device 195. FIG. 4 shows a basic voltage-doubler rectifier 215. When an AC input voltage 220 is applied to capacitors C11 and C12 via diodes D1 and D3, capacitor C11 charges to the positive peak of the input voltage minus a diode drop, and capacitor C12 charges to the negative peak voltage minus a diode drop. Thus, the sum of the voltages on capacitors C11 and C12 is the peak-to-peak voltage of the incoming AC waveform minus two diode drops. If the magnitude of the incoming AC waveform is sufficiently large, the two diode drops become insignificant.

Figure 6:
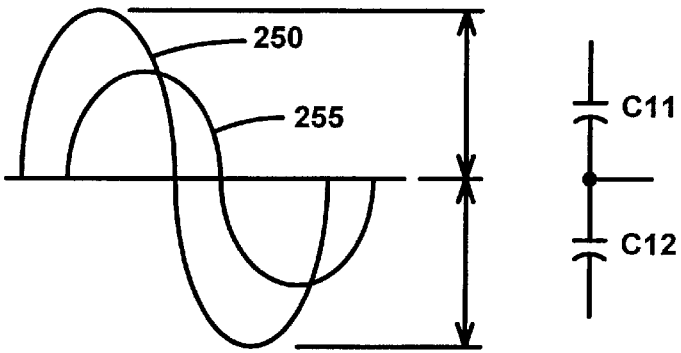
FIG. 6 is a schematic of two AC waveforms applied to the circuit shown in FIG. 5.
Figure 5:
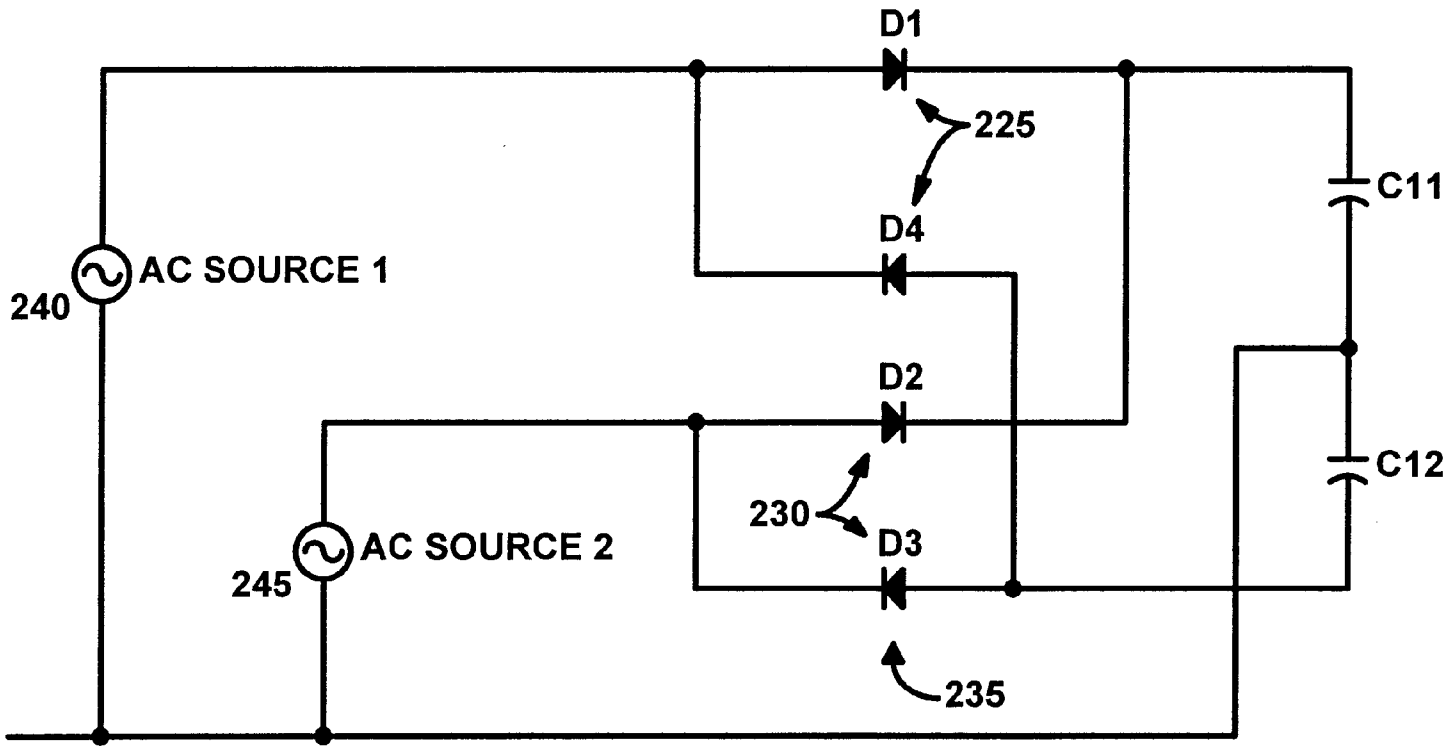
FIG. 5 is an electrical schematic of a circuit including a dual voltage-doubler rectifier electrically connected with two separate AC input sources.

FIG. 5 shows two voltage-doubler rectifiers 225 and 230 forming a dual voltage-doubler rectifier 235 with two separate corresponding AC input sources 240 and 245. The voltage-doubler rectifiers 225 and 230 charge the same pair of capacitors C11 and C12. As shown in FIG. 5, both input voltage sources are referenced to the same node in the circuit (i.e., the reference node). Capacitor C11 charges to the greater of the two positive incoming voltage values, and capacitor C12 charges to the greater of the two negative going incoming voltage values. If the two AC inputs represent two fault signals, capacitors C11 and C12 charge to and store the signal with the greater voltage. The magnitude of the lesser signal is irrelevant. FIG. 6 shows a pair of typical waveforms 250 and 255 for the dual voltage-doubler rectifier 235. While sine waves are shown, the inputs need not be sinusoidal. Also, the two input waveforms need not be in phase; all that matters is the peak voltage values of the two input waveforms. When applying the waveforms 250 and 255 to the dual voltage-doubler rectifier 235, the capacitors C11 and C12 charge to the greater of the peak values of the waveforms 250 and 255. For the waveforms 250 and 255 shown in FIG. 6, the capacitors C11 and C12 charge to the peaks of waveform 250.

For the OVP/GFI circuit 115 shown in FIG. 1, the voltage and current sensors 185 and 190 form a single sensor (referred to as an overvoltage-condition-and-ground-fault-condition sensor) having a dual voltage-doubler rectifier 260. The dual voltage-doubler rectifier 200 includes diodes D1, D2, D3 and D4. The earth ground connection is the "signal source" for the GFI circuit and is referenced to the reference node 265. The dual voltage-doubler rectifier effectively isolates the sources of the two fault signals, and "records" the greater of the two fault signals without either affecting the other.

The accuracy of the OVP/GFI circuit 115 is determined largely by the value of inexpensive 1% tolerance resistors R1–R4 and the accuracy of the diac D5 (and the fixed turns ratio of the transformer secondary and tap winding in the case of the OVP sub-circuit). Other factors have little impact on the trip setpoints. This is an improvement over typical fault circuits that include foil-tape-sensing elements. The size of the foil, temperature, and the dielectric constant of the potting material significantly effect foil-tape-sensing elements.

The sensing side of the fault circuit is referenced roughly at earth ground potential. The circuit shutdown side is referenced at circuit common. There is a difference of roughly 170 volts DC between these two points. This requires some isolation between these two parts of the circuit. Some prior art fault circuits used a DC level shifter circuit between these two points. This is a disadvantage for certification agency testing. Agency safety test specifications mandate a maximum leakage current that is allowed to pass between earth ground and the power conductors (hot and neutral) when a specified high voltage is applied between them. Since circuit common is electrically connected to (not isolated from) the incoming power lines, electrical isolation is required between the fault circuit and circuit common. Surge testing places a high potential across this barrier, which requires over-sized and more expensive components when a DC level shifter is used. Alternately, coupling transformers are often used to bridge this barrier. All of these alternatives are considerably more expensive than the opto-couplers used in the circuit of the invention.

One potential problem with inexpensive optocouplers is that some minimum LED current is needed to ensure the signal is coupled to the opto-transistor. This may be a problem in a circuit that is powered entirely by a signal source. The diac D5 offers a significant advantage in this regard. The diac D5 presents a high impedance to capacitors C1 and C2, while the capacitors C1 and C2 are charging toward the fault threshold. Once the breakdown threshold of the diac D5 has been reached (i.e., the fault trip threshold), the diac D5 switches into conduction in a negative-resistance fashion, and allows a large pulse of current to flow through the LED of the optocoupler. This insures that the signal is reliably coupled to the other side of the circuit, regardless of how much the fault threshold is exceeded. Again, this lends accuracy to the OVP/GFI circuit 115.

As can be seen from the above, the invention provides a new and useful gas-discharge lamp including a combination overvoltage-protection-and-ground-fault-interrupt circuit. Various features and advantages of the invention are set forth in the following claims.

What is claimed is:

1. A gas-discharge lamp comprising:

a power supply interconnectable to a load;

an overvoltage-protection-and-ground-fault-interrupt (OVP/GFI) circuit interconnected with the power supply, the OVP/GFI circuit including an overvoltage-protection (OVP) sub-circuit that deactivates the power supply when an overvoltage condition is detected, and a ground-fault-interrupt (GFI) sub-circuit that deactivates the power supply when a ground-fault condition is detected; and wherein the OVP sub-circuit includes a voltage sensor, a storage device interconnected with the voltage sensor and a shut-down device interconnected with the storage device, and wherein the GFI sub-circuit includes a current sensor, the storage device and the shut-down device, the current sensor being interconnected with the storage device.

2. The gas-discharge lamp as set forth in claim 1 wherein the power supply includes a transformer having a secondary winding and is operable to supply a first voltage to the load, wherein the voltage sensor generates a second voltage having a relationship to the first voltage, the second voltage having a first positive peak and a first negative peak, wherein the current sensor generates a third voltage having a relationship to a ground-fault current produced in the secondary winding, the third voltage having a second positive peak and a second negative peak, and wherein the storage device stores a fourth voltage, the fourth voltage being the combination of the larger of the first and second positive peaks and the larger of the first and second negative peaks.

3. The gas-discharge lamp as set forth in claim 2 wherein the shut-down device receives the fourth voltage and deactivates the power supply if the fourth voltage is greater than a fault voltage.

4. The gas-discharge lamp as set forth in claim 2 wherein the voltage sensor includes a sense winding mounted on the transformer and a voltage-doubler rectifier interconnected with the sense winding, and wherein the voltage-doubler rectifier produces the first voltage.

5. The gas-discharge lamp as set forth in claim 2 wherein the current sensor includes a winding tap interconnected to the secondary winding, a resistor interconnected to the winding tap, and a voltage-doubler rectifier interconnected to the resistor, and wherein the voltage-doubler rectifier produces the second voltage.

6. The gas-discharge lamp as set forth in claim 2 wherein the voltage sensor includes a sense winding mounted on the transformer, the sense winding having a winding tap interconnected with the secondary winding, and a first voltage-doubler rectifier interconnected with the sense winding, wherein the first voltage-doubler rectifier produces the second voltage, wherein the current sensor includes the winding tap, a resistor interconnected to the winding tap and a second voltage-doubler rectifier interconnected to the resistor, and wherein the second voltage-doubler rectifier produces the third voltage.

7. The gas-discharge lamp as set forth in claim 6 wherein the sense winding includes a second tap interconnected with the secondary winding.

8. The gas-discharge lamp as set forth in claim 1 wherein the shut-down device includes a diac, an opto-transistor interconnected to the diac, and a transistor interconnected with the opto-transistor.

9. The gas-discharge lamp as set forth in claim 1 wherein the shut-down device clamps the power supply from supplying power until power is removed from the power supply.

10. The gas-discharge lamp as set forth in claim 1 wherein the shut-down device includes a diac and an opto-silicon-controlled rectifier interconnected to the diac.

11. The gas-discharge lamp as set forth in claim 1 wherein the power supply further includes:

a terminal interconnectable to an alternating-current (AC) power source that provides AC power;

a rectifier that rectifies the AC power to create a direct-current (DC) voltage;

a logic power supply that receives the DC voltage and creates a bias voltage; and a driver circuit operable to receive the bias voltage and to produce a driving signal that drives the load with a voltage having a frequency.

12. The gas-discharge lamp as set forth in claim 11 wherein the shut-down circuit prevents the bias voltage from being applied to the driver circuit when a fault condition occurs.

13. The gas-discharge lamp as set forth in claim 11 wherein the load includes a gas-discharge tube.

14. A gas-discharge lamp comprising:

a power supply including a secondary winding interconnectable to a load, the power supply being operable to supply power to the load; and an overvoltage-protection-and-ground-fault-interrupt (OVP/GFI) circuit interconnected with the power supply, the OVP/GFI circuit including an overvoltage-condition-and-ground-fault-condition (OC/GFC) sensor that is operable to sense both an overvoltage condition being created by the power supply and a ground-fault condition being created in the secondary winding, and to generate a fault signal when either of the conditions occurs, and a shut-down device interconnected with the OC/GFC sensor, the shut-down device deactivates the power supply from supplying power to the load upon receiving the fault signal.

15. The gas-discharge lamp as set forth in claim 14 wherein the load includes a gas-discharge tube.

16. The gas-discharge lamp as set forth in claim 14 wherein the power supply further includes:

a terminal interconnectable to an alternating-current (AC) power source that provides AC power;

a rectifier that rectifies the AC power to create a direct-current (DC) voltage;

a logic power supply that receives the DC voltage and creates a bias voltage; and a driver circuit operable to receive the bias voltage and to produce a driving signal that drives the load with a voltage having a frequency.

17. The gas-discharge lamp as set forth in claim 16 wherein the shut-down circuit prevents the bias voltage from being applied to the driver circuit when a fault condition occurs.

18. The gas-discharge lamp as set forth in claim 14, wherein the OC/GFC sensor includes a dual voltage-doubler rectifier and a storage device.

19. The gas-discharge lamp as set forth in claim 18 wherein the power supply includes a transformer having a secondary winding, wherein the OC/GFC sensor includes a sense winding having a winding tap, and wherein the winding tap is interconnected with the secondary winding.

20. The gas-discharge lamp as set forth in claim 19 wherein the sense winding includes a second tap interconnected with the secondary winding.

21. The gas-discharge lamp as set forth in claim 14 wherein the shut-down device includes a diac, an opto-transistor interconnected to the diac, and a transistor interconnected with the opto-transistor.

22. The gas-discharge lamp as set forth in claim 14 wherein the shut-down device clamps the power supply from supplying power until power is removed from the power supply.

23. The gas-discharge lamp as set forth in claim 14 wherein the shut-down device includes a diac and an opto-silicon-controlled rectifier interconnected to the diac.

24. The gas-discharge lamp as set forth in claim 1 wherein the storage device includes a capacitor.

25. The gas-discharge lamp as set forth in claim 6 wherein the storage device includes at least one capacitor interconnected with the first and second voltage-doubler rectifiers.

26. The gas-discharge lamp as set forth in claim 7 wherein the secondary winding includes the sense winding.

27. The gas-discharge lamp as set forth in claim 18 wherein the storage device includes a capacitor.

28. The gas-discharge lamp as set forth in claim 20 wherein the secondary winding includes the sense winding.

29. A gas-discharge lamp comprising:

a power supply interconnectable to a load, the power supply including a transformer having primary and secondary windings;

an overvoltage-protection-and-ground-fault-interrupt (OVP/GFI) circuit interconnected with the power supply, the OVP/GFI circuit including an overvoltage-protection (OVP) sub-circuit that deactivates the power supply when an overvoltage condition is detected, the OVP sub-circuit including a voltage sensor having a sense winding mounted on the transformer, the sense winding including a winding tap interconnected with the secondary winding, and a ground-fault-interrupt (GFI) sub-circuit that deactivates the power supply when a ground-fault condition is detected, the GFI sub-circuit having a current sensor including the winding tap.

30. The gas-discharge lamp of claim 29 wherein the sense winding includes a second tap interconnected with the secondary winding.

31. The gas-discharge lamp of claim 30 wherein the secondary winding includes the sense winding.

32. The gas-discharge lamp of claim 29 wherein the OVP/GFI circuit further includes a storage device and a shutdown device.

33. The gas-discharge lamp as set forth in claim 32 wherein the storage device is interconnected with the voltage sensor and the current sensor, and wherein the shutdown device is interconnected with the storage device.

34. The gas-discharge lamp as set forth in claim 32 wherein the storage device includes a capacitor.

35. The gas-discharge lamp as set forth in claim 33 wherein the power supply further includes:

a terminal interconnectable to an alternating-current (AC) power source that provides AC power;

a rectifier that rectifies the AC power to create a direct-current (DC) voltage;

a logic power supply that receives the DC voltage and creates a bias voltage;

a driver circuit operable to receive the bias voltage and to produce a driving signal that drives the load with a voltage having a frequency; and wherein the shut-down circuit prevents the bias voltage from being applied to the driver circuit when a fault condition occurs.

36. The gas-discharge lamp as set forth in claim 29 wherein the load includes a gas-discharge tube.

* * * * *